US010141148B2

(12) United States Patent
Onoda et al.

(10) Patent No.: US 10,141,148 B2
(45) Date of Patent: Nov. 27, 2018

(54) AFFIXED OBJECT, FUSIBLE LINK, AND AFFIXING STRUCTURE FOR FUSIBLE LINK

(71) Applicant: Yazaki Corporation, Tokyo (JP)

(72) Inventors: Shinya Onoda, Makinohara (JP); Yoshinori Ishikawa, Makinohara (JP); Yoshinori Kitano, Susono (JP); Takahiro Shiohama, Susono (JP)

(73) Assignee: Yazaki Corporation, Tokyo (JP)

( * ) Notice: Subject to any disclaimer, the term of this patent is extended or adjusted under 35 U.S.C. 154(b) by 304 days.

(21) Appl. No.: 14/995,425

(22) Filed: Jan. 14, 2016

(65) Prior Publication Data

US 2016/0203936 A1 Jul. 14, 2016

(30) Foreign Application Priority Data

Jan. 14, 2015 (JP) ..... 2015-005306

(51) Int. Cl.
*H01H 85/22* (2006.01)
*H01H 85/02* (2006.01)
*H01H 85/20* (2006.01)

(52) U.S. Cl.
CPC .... *H01H 85/0241* (2013.01); *H01H 85/2045* (2013.01); *H01H 85/22* (2013.01); *H01H 2085/025* (2013.01)

(58) Field of Classification Search
CPC ..... H01H 85/0241; H01H 85/2045; H01H 85/22; H01H 2085/025; H01H 2085/2085
USPC ..... 337/190
See application file for complete search history.

(56) References Cited

U.S. PATENT DOCUMENTS 5,645,448 A * 7/1997 Hill ..... H01H 85/205 439/522
5,700,165 A * 12/1997 Harris ..... H01H 9/085 439/188
6,045,412 A * 4/2000 Guanco ..... H01R 13/4361 439/752
2004/0008503 A1* 1/2004 Higuchi ..... H01H 85/044 361/833
2009/0108981 A1* 4/2009 Iwata ..... G01R 1/0408 337/186
2010/0055962 A1* 3/2010 Ikeda ..... H01H 50/048 439/345
2012/0212884 A1* 8/2012 Su ..... F16B 2/245 361/679.01

(Continued)

FOREIGN PATENT DOCUMENTS

JP 2013-037949 A 2/2013

*Primary Examiner* — Anatoly Vortman
*Assistant Examiner* — Jacob R Crum
(74) *Attorney, Agent, or Firm* — Locke Lord LLP

(57) ABSTRACT

A connection portion of a locking member is bent such that the connection portion is made apart from a second upper surface portion as the connection portion is made apart from a first arm portion, and is bent such that the connection portion is made apart from a side surface portion as the connection portion is made apart from a second arm portion. Even when a tolerance is generated in a direction substantially orthogonal to the side surface portion at the time of installing a base body in an installation surface portion of a battery, it is possible to absorb the tolerance by deforming the connection portion, and to lock a locked portion in a lower end edge.

7 Claims, 4 Drawing Sheets

(56) References Cited

U.S. PATENT DOCUMENTS

2012/0262267 A1* 10/2012 Nohara ..... H01H 85/044
337/186

* cited by examiner

AFFIXED OBJECT, FUSIBLE LINK, AND AFFIXING STRUCTURE FOR FUSIBLE LINK

CROSS-REFERENCE TO RELATED APPLICATION

This application claims the benefit of Japanese Patent Application No. 2015-005306, the entire disclosure of which is incorporated by reference herein.

TECHNICAL FIELD

The present invention relates to an affixed object, a fusible link, and an affixing structure for the fusible link.

BACKGROUND

Related Art

An affixing structure of an electrical component (a fuse, a fusible link, or the like) for affixing the electrical component to a battery (for example, see JP 2013-37949 A) has been proposed as an example of an affixing structure for affixing an affixed object to an affixing object. The affixing structure of the electrical component as described in JP 2013-37949 A includes a battery terminal affixed to an electrode post of a battery, a fuse unit connected to the battery terminal, and a reinforcing plate into which a bolt vertically arranged on the battery terminal can be inserted. The fuse unit is affixed to the battery when a power supply-side terminal of the fuse unit serving as a nut is fastened to a bolt of the battery terminal through the reinforcing plate.

However, a conventional affixing structure of an electrical component as described in JP 2013-37949 A has a configuration in which an affixed object (fusible link) is affixed to a projection (electrode post) of an affixing object (battery), and thus a full load of the affixed object is applied to the projection. Therefore, a load on the projection is made increased. In this regard, a configuration is considered to reduce the load on the projection by employing an affixing structure for locking the affixed object in the affixing object using another component in addition to the above-described affixing structure. However, a tolerance may be generated in a relative position between the affixed object and the affixing object, and it is considered difficult in locking the affixed object in the affixing object in response to the tolerance.

An object of the invention is to provide an affixed object capable of being locked to an affixing object in response to a tolerance, a fusible link, and an affixing structure of the affixed object with respect to the affixing object.

SUMMARY

To solve the above-mentioned problem, a first aspect of the present invention provides an affixed object affixed to an affixing object including an installation surface portion, an intersection surface portion extending in a direction intersecting the installation surface portion, and a locking portion provided in the intersection surface portion, the affixed object including: an affixed-object body to be installed in the installation surface portion; and a locking member including a locked portion to be locked to the locking portion, the locking member being to be attached to the affixed-object body, wherein the locking member includes a first arm portion extending from the affixed-object body along the installation surface portion, an elastically deformable connection portion having one end connected to an end portion of the first arm portion, and a second arm portion having an end portion connected to the other end of the connection portion and extending along the intersection surface portion, wherein the second arm portion is provided with the locked portion, and wherein the connection portion is bent such that the connection portion is made apart from the installation surface portion as the connection portion is made apart from the first arm portion at the one end, is bent such that the connection portion is made apart from the intersection surface portion as the connection portion is made apart from the second arm portion at the other end, and is disposed with a gap between the connection portion and the affixing object.

A second aspect of the present invention provides the affixed object according to the first aspect, wherein the connection portion is configured to be elastically deformable such that the second arm portion is put close to and separated from the intersection surface portion while an intersection angle between the first arm portion and the second arm portion remains constant.

A third aspect of the present invention provides the affixed object according to the first or second aspect, wherein the second arm portion includes a bent portion bent to be separated from the intersection surface portion at the end portion on a side separated from the connection portion.

A fourth aspect of the present invention provides a fusible link affixed to a battery including an installation surface portion, an intersection surface portion extending in a direction intersecting the installation surface portion, and a locking portion provided in the intersection surface portion, the fusible link comprising: a main fusible link body installed in the installation surface portion; and a locking member including a locked portion to be locked to the locking portion, the locking member being to be attached to the main fusible link body, wherein the locking member includes a first arm portion extending from the main fusible link body along the installation surface portion, an elastically deformable connection portion having one end connected to an end portion of the first arm portion, and a second arm portion having an end portion connected to the other end of the connection portion and extending along the intersection surface portion, wherein the second arm portion is provided with the locked portion, and wherein the connection portion is bent such that the connection portion is made apart from the installation surface portion as the connection portion is made apart from the first arm portion at the one end, is bent such that the connection portion is made apart from the intersection surface portion as the connection portion is made apart from the second arm portion at the other end, and is disposed with a gap between the connection portion and the battery.

A fifth aspect of the present invention provides an affixing structure for affixing an affixing structure for affixing an affixed object to an affixing object, wherein the affixing object includes an installation surface portion, an intersection surface portion extending in a direction intersecting the installation surface portion, and a locking portion provided in the intersection surface portion to lock the affixed object, wherein the affixed object includes an affixed-object body installed in the installation surface portion, and a locking member including a locked portion to be locked to the locking portion, the locking member being to be attached to the affixed-object body, wherein the locking member includes a first arm portion extending from the affixed-object body along the installation surface portion, an elastically deformable connection portion having one end connected to an end portion of the first arm portion, and a second arm portion having an end portion connected to the other end of the connection portion and extending along the intersection surface portion, wherein the second arm portion is provided with the locked portion, and wherein the connection portion is bent such that the connection portion is made apart from the installation surface portion as the connection portion is made apart from the first arm portion at the one end, is bent such that the connection portion is made apart from the intersection surface portion as the connection portion is made apart from the second arm portion at the other end, and is disposed with a gap between the connection portion and the affixing object.

According to the first, fourth, and fifth aspects of the invention, a connection portion is bent such that the connection portion is made apart from an installation surface portion as the connection portion is made apart from a first arm portion, and is bent such that the connection portion is made apart from an intersection surface portion as the connection portion is made apart from a second arm portion. Thus, it is possible to appropriately change a relative position or an intersection angle (intersection angle obtained when each of the first arm portion and the second arm portion is virtually extended) between the first arm portion and the second arm portion by deforming the connection portion. Therefore, it is possible to absorb a tolerance generated between an affixing object (battery) and an affixed object (fusible link) by deforming the connection portion, lock a locked portion to a locking portion, and lock the affixed object to the affixing object.

Further, when the connection portion is bent as described above, the connection portion extrudes to an opposite side of the installation surface portion from the first arm portion and extrudes to an opposite side of the intersection surface portion from the second arm portion. When the locked portion is locked to the locking portion or locking of the locked portion is released, for example, the connection portion extruding as described above may be pressed by using a finger or pulled up by being held, thereby improving operability.

According to the second aspect of the invention, a hinge portion may be configured to be elastically deformable such that the second arm portion is put close to and separated from the intersection surface portion while an intersection angle between connection portions remains constant. Therefore, even when a tolerance is generated, and thus the second arm portion is excessively put close to or separated from the intersection surface portion at the time of installing an affixed-object body (main fusible link body) in the installation surface portion, the tolerance may be effectively absorbed.

According to the third aspect of the invention, since the second arm portion includes a bent portion bent to be separated from the intersection surface portion, locking of the locked portion in the locking portion may be easily released by operating the bent portion in a state in which the second arm portion is attached along the intersection surface portion.

DETAILED DESCRIPTION

Figure 1:
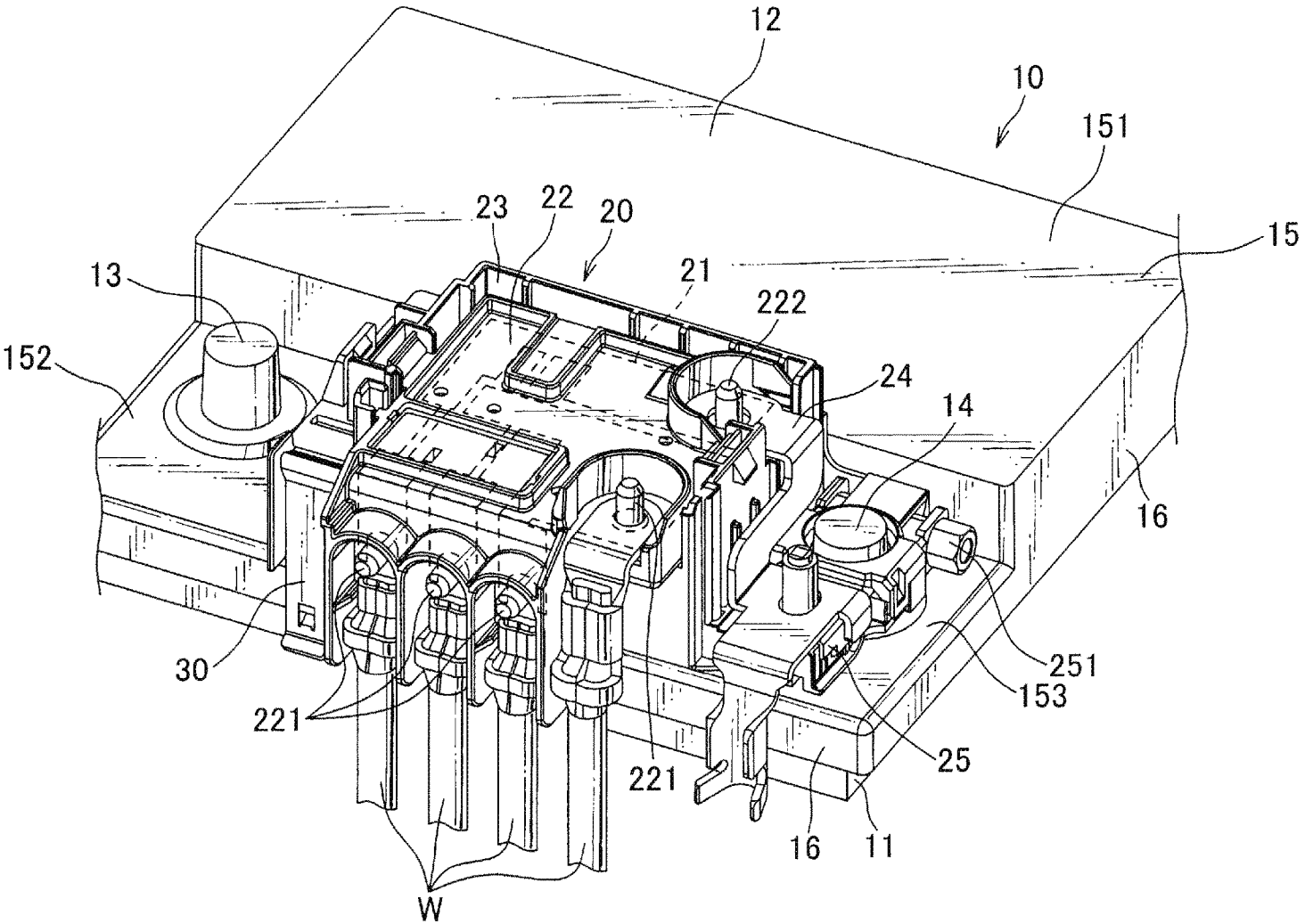
FIG. 1 is a perspective view illustrating an affixing structure of an electrical component according to an embodiment of the invention.
Figure 2:
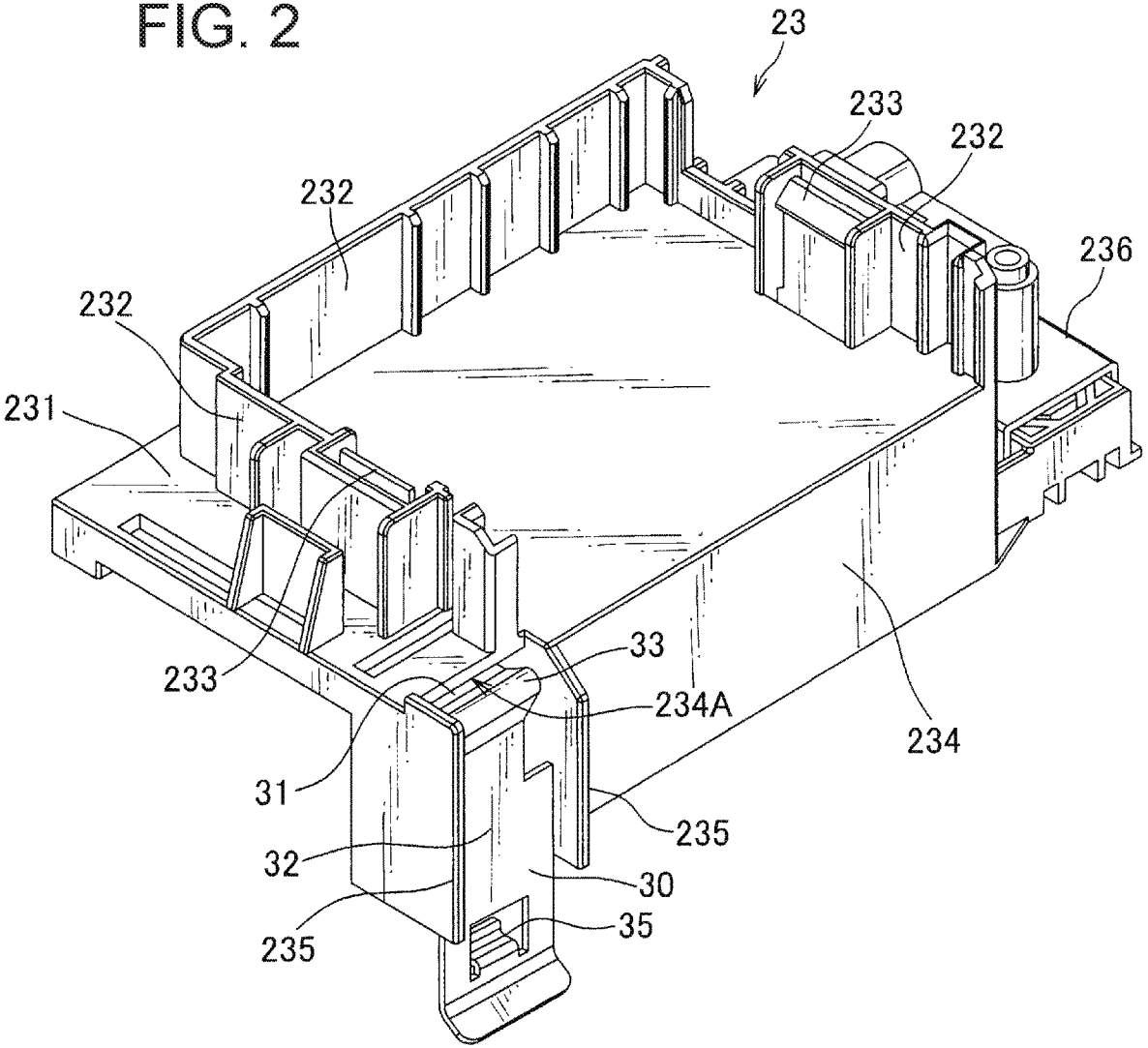
FIG. 2 is a perspective view illustrating a portion of the electrical component of FIG. 1.

Hereinafter, a description will be given of embodiments of the invention based on drawings. As illustrated in FIGS. 1 and 2, an affixing structure of an electrical component of the present embodiment is an affixing structure for affixing a fuse unit 20 serving as a fusible link (affixed object) to a battery (affixing object) 10 included in a vehicle. The fuse unit 20 is disposed between an electrode (a post 14 described below) of the battery 10 and a load to prevent an increase in temperature when an excess current flows or conducting is performed. The fuse unit 20 is configured to incorporate a bus bar 21 including a plurality of fuse portions that fuse when an excess current flows.

The battery 10 is formed in a shape of a box to include a lower case 11 that accommodates a main battery body and an upper case 12 that covers an upper portion of the lower case 11. A pair of left and right posts 13 and 14 corresponding to positive and negative electrode terminals is provided on the upper case 12 to extrude upward. The upper case 12 is formed in a shape of a case to include an upper surface portion (installation surface portion) 15 and four side surface portions (intersection surface portions) 16 continued from the upper surface portion 15 and hung down around a circumference. In addition, the upper surface portion 15 is formed in a stepped shape to include a first upper surface portion 151 positioned in an upper part, a second upper surface portion 152 lower than the first upper surface portion 151 around the post 13, a third upper surface portion 153 lower than the first upper surface portion 151 around the post 14, and a fourth upper surface portion (not illustrated) along the side surface portions 16 on a front surface side (a lower left side of FIG. 1) over the second upper surface portion 152 and the third upper surface portion 153.

The fuse unit 20 includes a main unit body 22 that incorporates the bus bar 21 in an integrated manner by insert molding, and a base body 23 installed in the battery 10 by supporting the main unit body 22. A plurality of terminals 221 connected to the bus bar 21 is installed on the main unit body 22 in a protruding manner, and the terminals 221 are connected to a load through a wire W. In addition, a power supply-side terminal 222 connected to the post 14 of the battery 10 is installed on the main unit body 22 in a protruding manner, and the power supply-side terminal 222 is connected to the post 14 through a bus bar 24 and a battery terminal 25. The battery terminal 25 is a connection member screwed and affixed to the post 14, and is provided with a bolt 251 for screwing and affixing the connected bus bar 24 using a nut. The main unit body 22 and the base body 23 function as a main fusible link body (affixed-object body).

The base body 23 is an article made of resin and molded as one body. As illustrated in FIG. 2, the base body 23 includes a base plate portion 231 placed on the first upper surface portion 151 of the upper case 12, a wall portion 232 rising from three end edges of the base plate portion 231, a pair of left and right lock portions 233 rising in a vicinity of the wall portion 232 on right and left sides, a front surface wall portion 234 falling from an end edge on a front side of the base plate portion 231, a pair of rib portions 235 protruding further forward than the front surface wall portion 234, and a connection member supporting portion 236 protruding along an upper surface of the third upper surface portion 153 of the upper case 12 on a side of the post 14. The main unit body 22 is surrounded on three sides by the wall portion 232 on a side of an upper surface of the base plate portion 231, and is connected and affixed to the base body 23 by being locked to the lock portions 233.

The base body 23 is installed in the upper surface portion 15 of the upper case 12 when the base plate portion 231 is placed on the first upper surface portion 151 of the upper case 12, a lower end edge of the front surface wall portion 234 is placed on the fourth upper surface portion, and the connection member supporting portion 236 is placed on the third upper surface portion 153. That is, the installation surface portion is configured by the upper surface portion 15 of the upper case 12. In addition, the battery terminal 25 is supported on the connection member supporting portion 236 of the base body 23, and the base body 23 is supported by the post 14 of the battery 10 through the battery terminal 25 when the battery terminal 25 is screwed and affixed to the post 14.

Figure 3:
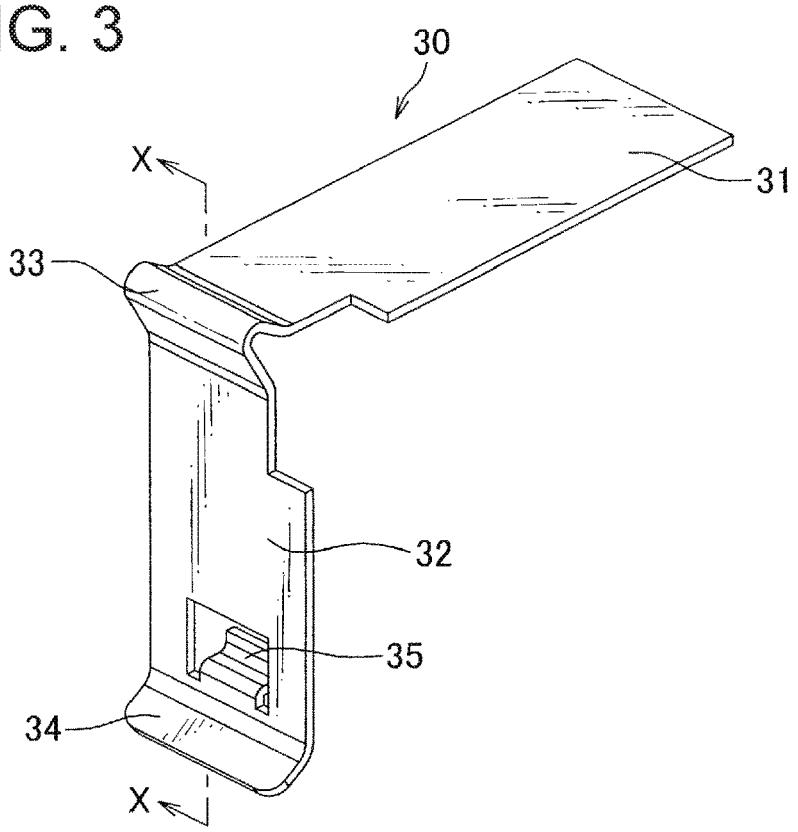
FIG. 3 is a perspective view illustrating a locking member provided in the electrical component of FIG. 2.
Figure 4:
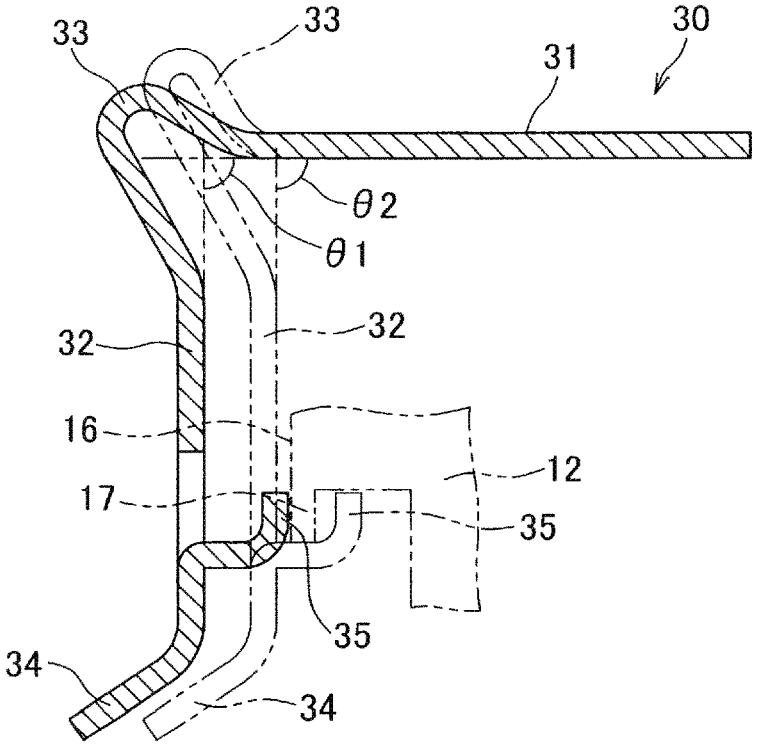
FIG. 4 is a cross-sectional view taken along link X-X of the locking member of FIG. 3.

Further, a locking member 30 made of metal is provided on the front surface wall portion 234 on a side separated from the connection member supporting portion 236 (a lower left side of FIG. 2) in the base body 23. As illustrated in FIGS. 3 and 4, the locking member 30 is formed to be elastically deformable in an L shape as a whole by including a first arm portion 31 and a second arm portion 32 that extend to intersect with each other and a connection portion 33 that connects the first arm portion 31 and the second arm portion 32 by being interposed therebetween, and is integrally molded from a metal plate by punching and folding. The first arm portion 31 is positioned between the pair of rib portions 235 of the base body 23, extends along the second upper surface portion 152, is affixed when an end portion thereof on a side separated from the connection portion 33 is inserted into an insertion hole 234A formed on the front surface wall portion 234, and is attached to the base body 23. The second arm portion 32 is provided to extend up to below a lower end edge 17 of the side surface portions 16 of the upper case 12.

A bent portion 34, which is bent to be separated from the side surface portions 16 of the upper case 12, is formed in a lower end portion of the second arm portion 32 (that is, an end portion on a side separated from the connection portion 33), and a locked portion 35, which is bent to a side of the upper case 12 and locked to the lower end edge (locking portion) 17 of the side surface portions 16, is formed on an upper side of the bent portion 34. The locked portion 35 is formed by cutting and raising the second arm portion 32, is bent to the side of the upper case 12, and is formed in an L shape on a cross section by being bent upward (to a side of the first arm portion 31). The second arm portion 32 is formed to have a width slightly smaller in size than a gap (inside dimension) between the pair of rib portions 235 in the base body 23, and is configured such that a position there of is adjustable in a left-right direction between the rib portions 235.

As illustrated in FIG. 4, the connection portion 33 is bent upward as the connection portion 33 is made apart from the first arm portion 31 (such that the connection portion 33 is made apart from the second upper surface portion 152) at one end connected to the end portion of the first arm portion 31, and is bent leftward as the connection portion 33 is made apart from the second arm portion 32 (such that the connection portion 33 is made apart from the side surface portions 16) at the other end connected to an end portion of the second arm portion 32. In other words, the connection portion 33 has a shape that extrudes in a direction in which the second upper surface portion 152 faces and extrudes in directions in which the side surface portions 16 face.

The above-described locking member 30 is formed such that the locked portion 35 is locked to the lower end edge 17 of the side surface portions 16 of the upper case 12 while the base body 23 is installed in the upper case 12. When the base body 23 is attached to the battery 10, for example, the connection portion 33 is pushed downward using a finger or the bent portion 34 is held and pushed downward such that the locked portion 35 is positioned below the lower end edge 17 in FIG. 4, thereby bending the first arm portion 31 and deforming the connection portion 33. In this instance, operation may be performed by taking the connection portion 33 between fingers. Further, the connection portion 33 is deformed to put the second arm portion 32 close to the side surface portions 16 such that the second arm portion 32 moves along the side surface portions 16, thereby locking the locked portion 35 in the lower end edge 17. In other words, the locking member 30 is deformed from an original shape indicated by a solid line to a shape indicated by a chain double-dashed line. In this instance, the locking member 30 is deformed such that an intersection angle θ1 (90° in the present embodiment) between the first arm portion 31 and the second arm portion 32 before deformation is equivalent to an intersection angle θ2 after deformation. In other words, the locking member 30 is configured to be elastically deformable such that the second arm portion 32 is put close to and separated from the side surface portions 16 while an intersection angle between the first arm portion 31 and the second arm portion 32 remains substantially constant.

Meanwhile, when the base body 23 is detached from the battery 10, locking of the locked portion 35 by the lower end edge 17 is released by distancing the second arm portion 32 from the side surface portions 16 while pushing the connection portion 33 downward using a finger or holding and pushing the bent portion 34 downward. In this instance, operation may be performed by taking the connection portion 33 between fingers.

According to the present embodiment described above, effects as below are achieved. In other words, since the locking member 30 includes the connection portion 33, even when a tolerance is generated in a direction substantially orthogonal to the side surface portions 16 at the time of installing the base body 23 in the installation surface portion of the battery 10, it is possible to absorb the tolerance by deforming the connection portion 33, and to lock the locked portion 35 in the lower end edge 17.

Further, when the locking member 30 is locked to the lower end edge 17 or locking of the locking member 30 is released, it is possible to deform the locking member 30 by pushing or holding the protruding connection portion 33, thereby improving operability.

Furthermore, since the bent portion 34 is formed in the second arm portion 32, it is possible to deform the locking member 30 by operating the bent portion 34 when the locking member 30 is locked to the lower end edge 17 or locking of the locking member 30 is released, thereby improving operability.

The invention is not limited to the above embodiment, and the invention includes another configuration capable of achieving an object of the invention and a modification as below.

Figure 5:
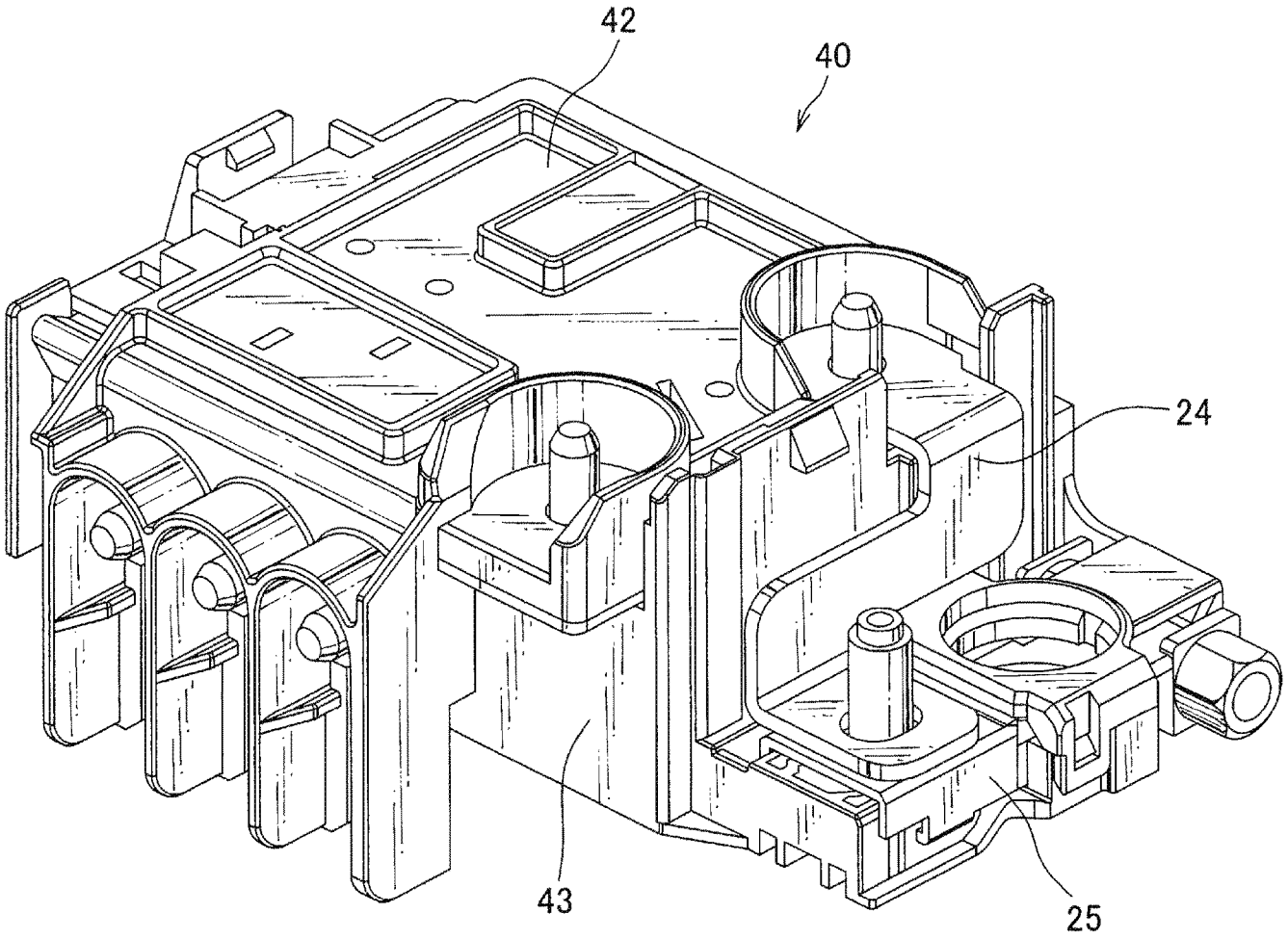
FIG. 5 is a perspective view illustrating an electrical component according to a modified example of the invention.

For example, in the above embodiment, the fuse unit 20 includes the main unit body 22 and the base body 23 as different bodies. However, as illustrated in FIG. 5, it is possible to configure a fuse unit 40 in which a main unit body 42 and a base body 43 are integrally molded. According to this configuration, there is no need to assemble the main unit body and the base body, and thus assembly man-hours may be reduced.

In addition, in the above embodiment, the bent portion 34 is formed in the second arm portion 32. However, for example, when the locked portion 35 can be easily locked to the lower end edge 17 or locking of the locked portion 35 can be easily released by operating the connection portion 33, the bent portion 34 may be omitted. When the bent portion 34 is omitted, a configuration of the locking member may be simplified.

Further, in the above embodiment, the locking member is configured using the metal plate. However, for example, the locking member may be configured using a member having elasticity such as resin and may be configured using a rod-shaped member.

Furthermore, in the above embodiment, the affixing structure of the electrical component is configured to affix the fuse unit 20 serving as the affixed object (fusible link) to the battery 10 serving as the affixing object. However, the structure may be configured such that the affixed object is affixed to the affixing object by the locking member. For example, a bus bar unit not including a fuse as an electrical component may be affixed to the battery, and the affixing object and the affixed object may not correspond to electrical components.

Further, even though the best configuration, method, and the like for implementing the invention are disclosed in the above description, the invention is not limited thereto. In other words, for the most part, the invention is particularly illustrated and described with regard to a specific embodiment. However, those skilled in the art may variously change a shape, a material, quantity, and other detailed configurations in the above-described embodiment without departing from the range of a technical sprit and an object of the invention. Therefore, the above description restricting a shape, a material, and the like is illustratively given to facilitate understanding of the invention, and does not restrict the invention. Thus, the invention includes description using a name of a member except for some or all restrictions on the shape, the material, and the like.

What is claimed is:

1. An affixed object affixed to an affixing object including an installation surface portion, an intersection surface portion extending in a direction intersecting the installation surface portion, and a locking portion provided in the intersection surface portion, the affixed object comprising:

an affixed-object body to be installed in the installation surface portion; and a locking member, attached to the affixed-object body, including:

a locked portion to be locked to the locking portion;

a first arm portion extending from the affixed-object body along the installation surface portion;

a connection portion which is elastically deformed and has one end connected to an end portion of the first arm portion; and a second arm portion having an end portion connected to the other end of the connection portion, extending along the intersection surface portion, and provided with the locked portion, wherein the locking member is provided on a wall portion of the affixed-object body such that the affixed-object body is sandwiched between the locking member and the affixing object when the affixed object is affixed to the affixing object, wherein the connection portion is bent such that the one end of the connection portion extends away from the installation surface portion as the connection portion extends away from the first arm portion, and the other end of the connection portion extends away from the intersection surface portion as the connection portion extends away from the second arm portion, and wherein a gap is formed between the connection portion and the affixing object.

2. The affixed object according to claim 1, wherein the connection portion is elastically deformable to adjust the second arm portion with respect to the intersection surface portion while an intersection angle between the first arm portion and the second arm portion remains constant.

3. The affixed object according to claim 1, wherein the second arm portion includes a bent portion bent to be separated from the intersection surface portion at the end portion on a side separated from the connection portion.

4. The affixed object according to claim 2, wherein the second arm portion includes a bent portion bent to be separated from the intersection surface portion at the end portion on a side separated from the connection portion.

5. A fusible link affixed to a battery including an installation surface portion, an intersection surface portion extending in a direction intersecting the installation surface portion, and a locking portion provided in the intersection surface portion, the fusible link comprising:

a main fusible link body installed in the installation surface portion; and a locking member, attached to the main fusible link body, including:

a locked portion to be locked to the locking portion;

a first arm portion extending from the main fusible link body along the installation surface portion;

a connection portion which is elastically deformed and has one end connected to an end portion of the first arm portion; and a second arm portion having an end portion connected to the other end of the connection portion, extending along the intersection surface portion, and provided with the locked portion, wherein the locking member is provided on a wall portion of the main fusible link body such that the main fusible link body is sandwiched between the locking member and the battery when the fusible link is affixed to the battery, wherein the connection portion is bent such that the one end of the connection portion extends away from the installation surface portion as the connection portion extends away from the first arm portion, and the other end of the connection portion extends away from the intersection surface portion as the connection portion extends away from the second arm portion, and wherein a gap is formed between the connection portion and the battery.

6. An affixing structure for affixing an affixed object to an affixing object, wherein the affixing object includes an installation surface portion, an intersection surface portion extending in a direction intersecting the installation surface portion, and a locking portion provided in the intersection surface portion to lock the affixed object, wherein the affixed object includes an affixed-object body installed in the installation surface portion, and a locking member including a locked portion to be locked to the locking portion, the locking member being to be attached to the affixed-object body, wherein the locking member includes a first arm portion extending from the affixed-object body along the installation surface portion, an elastically deformable connection portion having one end connected to an end portion of the first arm portion, and a second arm portion having an end portion connected to the other end of the connection portion and extending along the intersection surface portion, wherein the second arm portion is provided with the locked portion, wherein the locking member is provided on a wall portion of the affixed-object body such that the affixed-object body is sandwiched between the locking member and the affixing object when the affixed object is affixed to the affixing object, and wherein the connection portion is bent such that the one end of the connection portion extends away from the installation surface portion as the connection portion extends away from the first arm portion, and the other end of the connection portion extends away from the intersection surface portion as the connection portion extends away from the second arm portion, and wherein a gap is formed between the connection portion and the affixing object.

7. The affixed object according to claim 2, wherein the intersection angle is 90°.

* * * * *